US009790567B2

(12) United States Patent
Jamwal et al.

(10) Patent No.: US 9,790,567 B2
(45) Date of Patent: Oct. 17, 2017

(54) PROCESS FOR MAKING COATED COLD-ROLLED DUAL PHASE STEEL SHEET

(71) Applicant: THYSSENKRUPP STEEL USA, LLC, Calvert, AL (US)

(72) Inventors: Ranbir Jamwal, Mobile, AL (US); Joseph Frimpong, Saraland, AL (US); Bertram Wilhelm Ehrhardt, Mobile, AL (US); Harald Van Bracht, Theodore, AL (US); Roger Dale Boggs, Columbus, MS (US); Stanley Wayne Bevans, S.W. Decatur, AL (US)

(73) Assignee: Thyssenkrupp Steel USA, LLC, Calvert, AL (US)

( * ) Notice: Subject to any disclaimer, the term of this patent is extended or adjusted under 35 U.S.C. 154(b) by 260 days.

(21) Appl. No.: 14/084,942

(22) Filed: Nov. 20, 2013

(65) Prior Publication Data

US 2014/0141279 A1 May 22, 2014

Related U.S. Application Data

(60) Provisional application No. 61/728,517, filed on Nov. 20, 2012.

(51) Int. Cl.
*C21D 8/02* (2006.01)
*C21D 8/04* (2006.01)

(52) U.S. Cl.
CPC ..... *C21D 8/0226* (2013.01); *C21D 8/0263* (2013.01); *C21D 8/0436* (2013.01);
(Continued)

(58) Field of Classification Search
CPC ..... Y10T 428/12799; C21D 8/0436
(Continued)

(56) References Cited

U.S. PATENT DOCUMENTS 6,143,100 A * 11/2000 Sun ..... C21D 9/48 148/533
7,118,809 B2 * 10/2006 Utsumi ..... C21D 8/00 427/433

(Continued)

FOREIGN PATENT DOCUMENTS

EP 1160346 A1 12/2001
RU 2351661 C1 4/2009

(Continued)

OTHER PUBLICATIONS

ASM International Handbook Committee. (1991). ASM Handbook, vol. 04—Heat Treating—16.3 Applications of Thermomechanical Processing to Heat Treat As-Rolled Microalloyed Steels. ASM International.*

*Primary Examiner* — Colleen Dunn
*Assistant Examiner* — Jeremy Jones
(74) *Attorney, Agent, or Firm* — Dinsmore & Shohl LLP

(57) ABSTRACT

A coated dual-phase steel and process for producing the coated dual-phase steel is provided. The process includes providing a steel slab with a desired chemistry, soaking the slab at an elevated temperature and then hot rolling the slab to produce hot-rolled strip. The hot-rolled strip is coiled and has a ferrite-pearlite microstructure. The coiled hot-rolled strip is cold-rolled into cold-rolled sheet with at least a 60% reduction in thickness compared to the thickness of the coiled hot-rolled strip. The cold-rolled sheet is subjected to an intercritical anneal followed by rapid cooling with the absence of an isothermal heat treatment or hold after rapid cooling near the molten metal pot temperature—during which, before or after which the steel is coated. The coated steel sheet has a dual-phase ferrite-martensite microstructure, a yield strength of at least 310 MPa, a tensile strength of at least 580 MPa and a total elongation to failure of at least 18%.

7 Claims, 5 Drawing Sheets

(52) U.S. Cl.
CPC ..... *C21D 8/0473* (2013.01); *C21D 2211/002* (2013.01); *C21D 2211/005* (2013.01); *C21D 2211/008* (2013.01); *Y10T 428/12799* (2015.01)

(58) Field of Classification Search
USPC ..... 148/529, 537
See application file for complete search history.

(56) References Cited

U.S. PATENT DOCUMENTS

| | | | | |
|---|---|---|---|---|
| 7,767,036 | B2 * | 8/2010 | Kashima | C21D 6/00 148/320 |
| 8,460,481 | B2 * | 6/2013 | Azuma | C21D 8/0236 148/320 |
| 8,828,557 | B2 * | 9/2014 | Takagi | C21D 8/0405 148/579 |
| 2001/0007280 | A1 * | 7/2001 | Claessens | C21D 9/52 164/476 |
| 2001/0015245 | A1 * | 8/2001 | Eberle | C21D 1/185 148/624 |
| 2004/0047756 | A1 * | 3/2004 | Rege | C21D 1/20 420/104 |
| 2006/0191612 | A1 * | 8/2006 | Yoshida | C22C 38/12 148/603 |
| 2010/0043925 | A1 * | 2/2010 | Sun | C22C 38/002 148/330 |
| 2011/0168300 | A1 * | 7/2011 | Moulin | C21D 8/0278 148/522 |

FOREIGN PATENT DOCUMENTS

| | | | |
|---|---|---|---|
| WO | 03018858 | A1 | 3/2003 |
| WO | 2004079022 | A1 | 9/2004 |

* cited by examiner

PROCESS FOR MAKING COATED COLD-ROLLED DUAL PHASE STEEL SHEET

RELATED APPLICATION

This application claims priority to U.S. Provisional Patent Application Ser. No. 61/728,517 filed Nov. 20, 2012, which is incorporated in its entirety herein by reference.

FIELD OF THE INVENTION

The present invention is related to a process for making a coated cold-rolled dual phase steel sheet, and in particular to a process that uses a high intercritical annealing temperature followed by rapid cooling and without the presence of a hold temperature treatment before entering a liquid coating bath.

BACKGROUND OF THE INVENTION

Low-carbon steels having a yield strength of approximately 170 megapascals (MPa) and excellent deep drawing ability are used in a variety of industries, e.g. the automobile industry. However, and despite their forming and cost advantages over high-strength steels, the relatively low-strength level results in the crash performance of such materials being mainly dependent on a thickness of a sheet thereof. As such, first generation advanced high-strength steels (AHSS) have been developed in order to reduce the weight of automotive components and thus afford for improved vehicle fuel efficiency.

In particular, dual-phase steels have been developed by subjecting low-carbon steels to an intercritical anneal followed by sufficiently rapid cooling. It is appreciated that an intercritical anneal refers to annealing the steel at a temperature or temperature range below the materials $Ac_3$ temperature and above the $Ac_1$ temperature where the microstructure consists of ferrite and austenite, thereby affording for the rapid cooling to transform the austenite into martensite such that a predominantly dual-phase ferrite-martensite microstructure is produced. It is also appreciated and/or known in the art that alloying elements such as manganese, chromium, molybdenum and niobium can be used to reduce the rate of cooling required for the transformation of the austenite to martensite. However, the addition of such alloying elements naturally increases the cost of the steel.

Three basic methods are known for the commercial production of dual-phase steels. First, an as-hot-rolled method produces the dual-phase microstructure during conventional hot-rolling through the control of chemistry and processing conditions. Second, a continuous annealing approach typically takes coiled hot- or cold-rolled steel strip, uncoils and anneals the steel strip in an intercritical temperature range in order to produce a ferrite plus austenite microstructure/matrix. Thereafter, sufficiently rapid cooling higher than the critical cooling rate for the steel chemistry is applied to the strip to produce the ferrite-martensite microstructure. Finally, the third method batch anneals hot- or cold-rolled material in the coiled condition.

The temperature or temperature range of the intercritical anneal is important since for a given alloy composition the intercritical anneal temperature controls or determines the amount of austenite, and its carbon content, that can be transformed to martensite. As such, high intercritical annealing temperatures have been disclosed as unsatisfactory in the prior art due to the presence of a high amount of austenite with a reduced carbon content which results in the formation of auto tempered martensite upon cooling. Previous embodiments as in U.S. Pat. No. 6,811,624 have mentioned lower temperature ranges in terms of $Ac_1$ calculation based on the steel chemistry and combining this low temperature soak with a substantial isothermal heat treatment which is imperative to obtain predominantly ferrite-martensite structure.

However, such low soak temperatures and "substantial isothermal heat treatment" to annealed steel strip or can extend processing time of the material and thus increase costs. Therefore, an improved process for producing a coated dual-phase steel on a production scale would be desirable.

SUMMARY OF THE INVENTION

A process for producing a coated dual-phase steel is provided. The process includes providing a steel slab with a chemical composition within the range, in weight percent, of 0.085-0.11 carbon (C), 1.4-2.0 manganese (Mn), 0.09-0.21 molybdenum (Mo), 0.02-0.05 aluminum (Al), 0.16 minimum (min) silicon (Si), 0.13 min chromium (Cr), 0.016 maximum (max) titanium (Ti), 0.06 max nickel (Ni), 0.003 max sulfur (S), 0.015 max phosphorus (P), 0.006 max nitrogen (N), balance iron (Fe) and incidental melting impurities. For the purpose of the invention the Si and Cr content is restricted to 0.5 max.

The steel slab is soaked at an elevated temperature between 1160-1280° C. and then hot rolled to form hot-rolled strip. The hot-rolled strip is coiled at temperatures between 600-680° C. and the coiled hot-rolled strip has a ferrite-pearlite microstructure. The coiled hot-rolled strip is uncoiled and cold rolled into cold-rolled sheet. The cold-rolled sheet has at least a 60% reduction in thickness compared to the thickness of the coiled hot-rolled strip.

Intercritical annealing of the cold-rolled sheet is conducted or executed at temperatures between 780-820° C., followed by rapid cooling of the cold-rolled sheet to a temperature between 500-520° C. The rapid cooling to the temperature between 500-520° C. is conducted without an isothermal or hold temperature treatment and the cooled sheet is passed through a molten metal or alloy bath that is held at temperatures between 450-480° C. in order to produce a coated steel sheet. The coated steel sheet has a dual-phase ferrite-martensite microstructure with less than 4 volume percent bainite. In addition, the coated steel sheet has a yield strength of at least 310 megapascals (MPa), a tensile strength of at least 580 MPa, a total elongation to failure of at least 18%, and a uniform elongation of at least 10%.

In some instances, the coated steel sheet has a yield strength between 330-450 MPa, a tensile strength between 590-680 MPa, a total elongation between 21-26%, and a uniform elongation between 13-17%. In addition, the coated steel sheet has a work hardening exponent 'n' between 0.1-0.2, and in some instances 'n' is between 0.14-0.18. The coated steel sheet can also have a Lankford coefficient r-value between 0.5-1.5, and in some instances the r-value is between 0.8-1.1. The coated steel sheet can further be bake hardened and have an increase in strength of at least 30 MPa.

A coated dual-phase steel is also provided, the coated dual-phase steel in the form of cold-rolled sheet having a chemical composition as provided or described above. In addition, the cold-rolled sheet has a metallic coating thereon. The cold-rolled sheet has a dual-phase ferrite-martensite microstructure with less than 4 volume percent bainite. The mechanical properties of the coated cold-rolled sheet include a yield strength between 330-450 MPa, a tensile strength between 590-680 MPa, a total elongation of at least 18%, and a uniform elongation of at least 10%.

In some instances, the coated dual-phase steel in the form of the cold-rolled sheet with the metallic coating thereon has a total elongation between 21-26%. Also, the cold-rolled sheet with the metallic coating thereon can have a uniform elongation between 13-17%. The coated dual-phase steel can have a work hardening exponent 'n' between 0.1-0.2, and in some instances 'n' is between 0.14-0.18. Also, the coated dual-phase steel can have a Lankford coefficient r-value between 0.5-1.5, and in some instances the r-value is between 0.8-1.1.

DETAILED DESCRIPTION OF THE INVENTION

Figure 1:
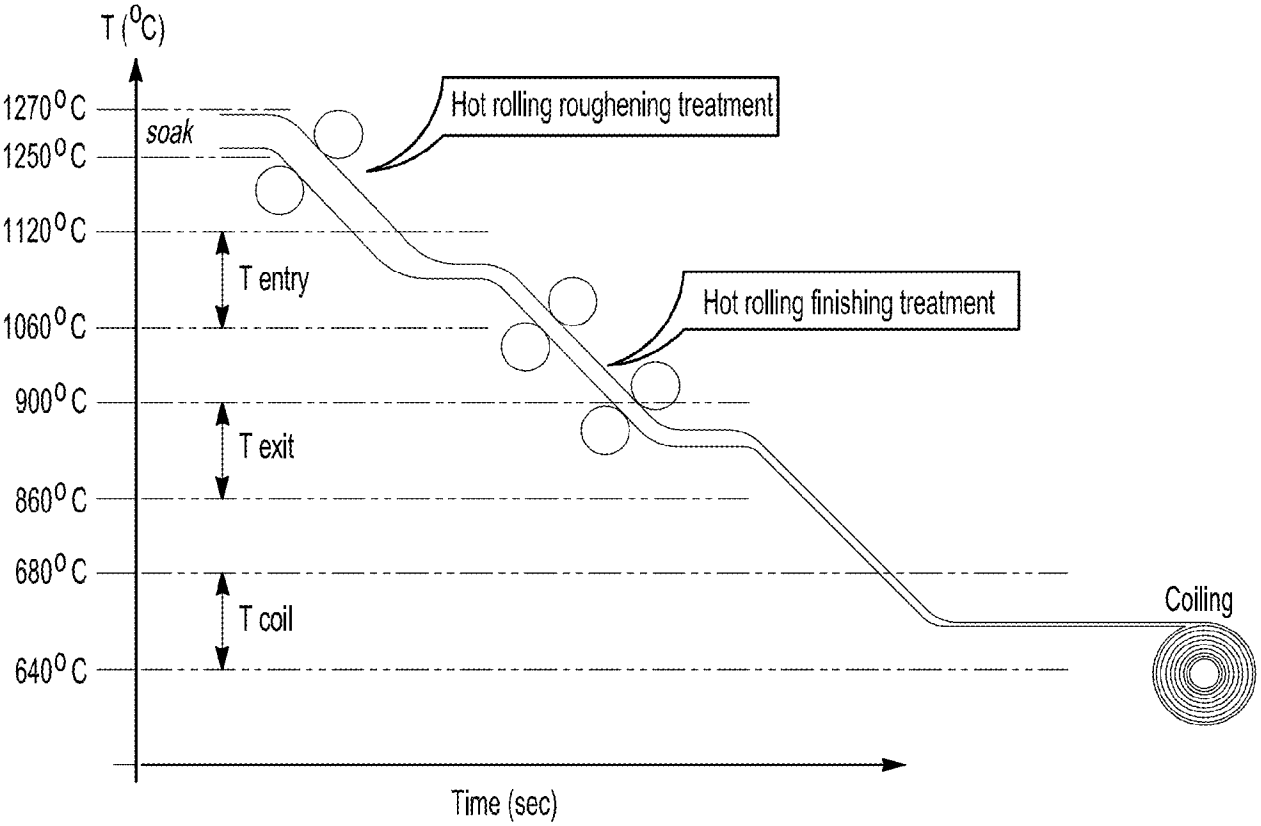
FIG. 1 is a graphical plot/illustration of temperature versus time for production of hot-rolled strip according to an embodiment of the present invention.

A coated, e.g. galvanized or galvannealed, dual-phase steel having a microstructure of ferrite plus martensite and a process for producing the steel is provided. As such, the invention has utility as a material for manufacturing parts, components, etc., and process for making the material.

The process includes producing cold-rolled full hard low-carbon steel sheet having a ferrite-pearlite initial microstructure and subjecting the steel sheet to an intercritical anneal within a hot dip galvanizing (HDG) line. Thereafter, the material is subjected to a "continuous" rapid gas jet cooling treatment before passing through a liquid coating material, e.g. a pot of a liquid galvanizing alloy, galvannealing alloy, etc. In addition, there is no hold temperature or isothermal heat treatment between the rapid cooling treatment and coating process. In this manner, a coated dual-phase steel having a 0.2% yield strength of at least 330 MPa, a tensile strength of at least 590 MPa, and a percent elongation of at least 21% is provided. In addition, the material can be baked hardened and exhibit a bake hardening increase in strength of at least 30 MPa.

In a preferred embodiment, a steel slab having a chemical alloy composition, in weight percent (wt %), within the range of 0.085-0.11 carbon (C), 1.4-2.0 manganese (Mn), silicon (Si) no less than 0.16 to 0.5 maximum (max), chromium (Cr) no less than 0.13 to 0.5 max, titanium (Ti) 0.016 max, 0.09-0.21 molybdenum (Mo), 0.06 max nickel (Ni), 0.003 max sulfur (S), 0.015 max phosphorus (P), 0.006 max nitrogen (N), and 0.02-0.05 aluminum (Al) with the balance iron (Fe) and incidental melting impurities known to those skilled in the art is provided and subjected to the inventive process disclosed herein. In addition, in some instances, the ratio of weight percent aluminum divided by 27 to weight percent nitrogen divided by 14 can be less than 10 ([wt % Al/27]/[wt % N/14]<10).

A slab of steel having a chemical composition within the above-stated range is soaked at an elevated temperature, e.g. 1160-1280° C., to ensure that most if not all of the alloying elements are in solid solution. The slab is then subjected to a roughing treatment and a finishing treatment to produce hot-rolled strip (also known and referred to as "hot strip") coil having a thickness between 2.3 and 5.3 millimeters (mm). The finishing treatment can have an entry temperature between 1050-1120° C. and an exit temperature between 860-910° C. In addition, the hot strip can be cooled after the finishing treatment at a cooling rate between 15-35° C./sec before being coiled at a temperature or temperature range between 600-680° C. Such processing parameters provide or give the hot strip coil a ferrite-pearlite microstructure for downstream processing.

The hot strip coil with the ferrite-pearlite microstructure is subjected to cold-rolling with at least a 60% reduction in thickness of the strip followed by intercritical annealing in a HDG line. The intercritical annealing temperature is between 780-820° C. with an annealing time between 70-90 seconds. In some instances, the intercritical annealing temperature is between 790-810° C., while in other instances it is between 790-800° C.

Heretofore known processes limit the intercritical anneal temperature to below 780-790° C. (based on $Ac_1$ calculation) and combine the low annealing temperature with a hold step near a molten metal pot where coating of the material occurs. It is appreciated that during, before or after the hold step the steel is coated. Also, higher than the 780-790° C. intercritical annealing temperature when combined with an isothermal hold, prior art processes result in substantial amounts of undesired low transformation products such as bainite being present in a final room temperature microstructure.

In contrast, the embodiments of the instant invention use high soak temperatures, i.e. high intercritical annealing temperatures greater than 790° C., preferably 800° C., combined with 'continuously' rapid cooling to a stop temperature (RC temperature) that is "away" from the bainitic range for current chemistries. As such, inventive embodiments obtain an ideal dual phase microstructure without the use of an isothermal heat treatment or hold near the molten metal pot temperature.

In some instances, the cold-rolled sheet subjected to the intercritical annealing treatment is rapidly gas jet cooled to a temperature between 500-520° C. In some instances, the cold-rolled sheet is rapidly gas jet cooled to a temperature between 505-515° C. after the intercritical anneal. Thereafter, the cooled sheet is passed through a liquid bath of a galvanizing alloy, a galvannealing alloy, etc., that is held at a temperature between 455-465° C. It is appreciated that passing the sheet through the liquid bath results in the sheet being coated, e.g. galvanized, as known to those skilled in the art. After passing through the liquid bath, the coated sheet is allowed to air cool or, in the alternative, can be subjected to an alternative cooling treatment, e.g. forced air cooling. Alternative to galvanizing, the coated steel strip may also be heated in an inductive furnace in a conventional galvanneal process to obtain an alloyed coating prior to final cooling.

The coated steel sheet has a dual-phase ferrite-martensite microstructure with less than 4 volume percent (vol %) bainite present. In addition, the thickness of the coated cold-rolled strip is a maximum of 2.3 mm and possesses good weldability. The coated sheet has a 0.2% yield strength between 330-450 MPa, a tensile strength between 590-680 MPa, a total percent elongation between 21-26%, and a uniform elongation between 13-17%. In addition, the coated steel can have a work hardening exponent 'n' between 0.1-0.2, and in some instances 'n' is between 0.14-0.18. The coated steel sheet can also have a Lankford coefficient r-value between 0.5-1.5, and in some instances the r-value is between 0.8-1.1. Finally, bake hardening of the material, e.g. subjecting the material to an elevated temperature of approximately 170° C. for 20 minutes, provides an increase in strength of at least 30 MPa.

For the purposes of the present invention, the work hardening exponent 'n', also known as the "n-value," is defined by the expression of the form $\sigma=K\epsilon^n$ where for an induced strain $\epsilon$, the corresponding stress $\sigma$ is the new yield strength of the material caused by the degree of cold working that has induced the strain $\epsilon$. As such, and not being bound by theory, the greater the value of n for a material, the greater the degree of work hardening the material exhibits upon cold forming and thus giving a measure of increased global formability. Also, the r-value is defined by the expression $$r = \epsilon_{xy}^p / \epsilon_z^p$$

where x and y are the coordinates in the plane of the sheet, z is the thickness direction, $\epsilon_{xy}^p$ is the plastic strain in-plane and $\epsilon_z^p$ is the plastic strain through the thickness direction.

Figure 2:
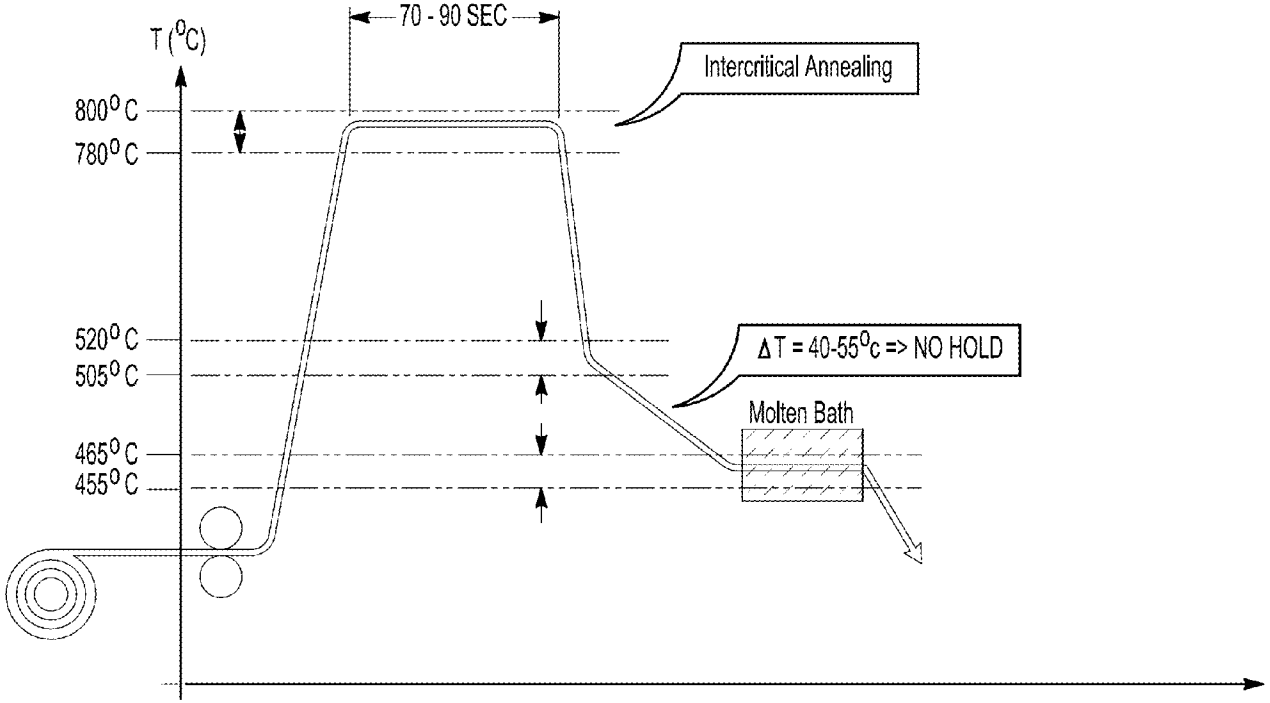
FIG. 2 is a graphical plot/illustration of intercritical annealing and continuous cooling, i.e. cooling without an isothermal or hold temperature treatment, of cold-rolled sheet followed by immersion into a molten metal or alloy bath according to an embodiment of the present invention.
Figure 3:
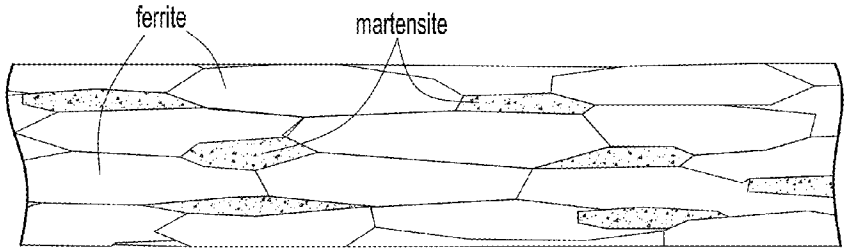
FIG. 3 is schematic diagram of a dual phase microstructure for a coated dual phase steel according to an embodiment to the present invention.
Figure 4:
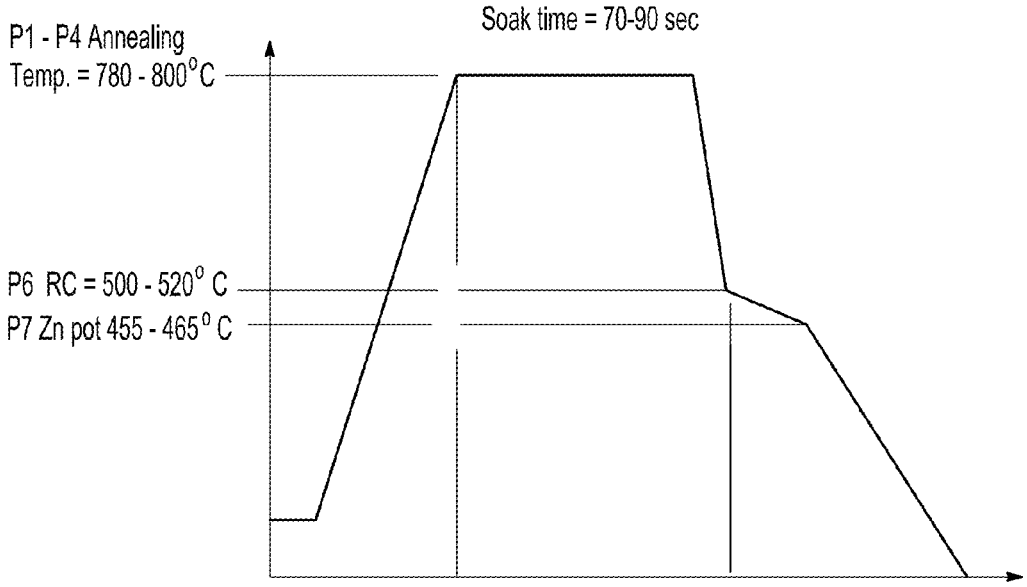
FIG. 4 is a graphical plot of temperature versus time for an intercritical anneal and continuous cooling, i.e. cooling without an isothermal or hold temperature treatment, of cold-rolled sheet followed by immersion into a molten metal or alloy bath according to an embodiment of the present invention, where the labels P1-P4 refer to heating and soak pyrometer readings respectively, P6 refers to an end of rapid cooling temperature pyrometer reading and P7 refers to galvanizing pot pyrometer reading.

Turning now to FIG. 1, a graphical plot/illustration of time versus temperature for producing hot strip coil according to an embodiment of the present invention. As shown in the figure, the slab is first soaked, then hot rolled using a roughing treatment to produce a transfer bar, the transfer bar hot rolled using a finishing treatment to produce hot strip which is then coiled. In addition, FIG. 2 illustrates cold rolling of the coiled hot strip, followed by intercritical annealing of the cold-rolled sheet, then rapid continuous cooling of the intercritically annealed sheet followed by passing the cooled sheet through a molten bath for coating. Finally, FIG. 3 provides a schematic illustration of a resultant final microstructure of the material with islands of martensite in a matrix of ferrite and FIG. 4 provides another graphical plot of the temperature versus time profile for the cold rolling—intercritical annealing—cooling—coating process. As shown in FIG. 4, temperatures of the sheet and molten bath can be determined with pyrometers during the intercritical annealing step (P1 and P4), the final rapidly cooled (RC) stop temperature (P6) and the coating step (P7).

EXAMPLE 1

Steel slabs having a thickness of approximately 255 mm and heat chemistries (wt %) referred to as Heat 1, Heat 2, Heat 3, Heat 4 and defined in Table 1 were soaked at approximately 1270° C. After soaking, the slabs were subjected to a hot rolling roughing treatment to produce transfer bars. The transfer bars were subjected to hot rolling finishing treatments with an entry temperature of 1080° C. and an exit temperature of 880° C. in order to produce hot strip with a thickness between 2.3 and 5.5 mm. The hot strip was cooled at a cooling rate of approximately 20° C./sec to 660° C. before being coiled.

TABLE 1

| | C | Mn | Si | P | S | Al | N | Cr | Ti | Mo | Nb | Ni |
|---|---|---|---|---|---|---|---|---|---|---|---|---|
| Heat 1 | 0.102 | 1.462 | 0.174 | 0.0147 | 0.0031 | 0.0434 | 0.004 | 0.15 | 0.0019 | 0.195 | 0.0021 | 0.014 |
| Heat 2 | 0.104 | 1.479 | 0.172 | 0.0152 | 0.0017 | 0.0348 | 0.0047 | 0.143 | 0.002 | 0.193 | 0.0014 | 0.012 |
| Heat 3 | 0.106 | 1.501 | 0.179 | 0.0145 | 0.0022 | 0.041 | 0.0049 | 0.146 | 0.0019 | 0.201 | 0.002 | 0.016 |
| Heat 4 | 0.102 | 1.408 | 0.179 | 0.0153 | 0.0024 | 0.0331 | 0.0038 | 0.162 | 0.0023 | 0.197 | 0.002 | 0.014 |

The coiled hot strip was cold-rolled to produce cold rolled sheet with at least a 60% reduction in thickness compared to the initial coiled hot strip thickness. Thereafter, the cold rolled sheet was subjected to intercritical annealing on a HDG line at 800° C. for 80 seconds, followed by rapid cooling to approximately 505° C.+/−10° C., before passing through a liquid galvanizing alloy having a temperature or temperature range between 455-465° C. No hold or isothermal heat treatment between the rapid cooling and liquid bath was performed on the material and the coated steel sheet had thicknesses ranging from 0.80-2.20 mm.

Samples from the coated steel sheet were subjected to standard mechanical testing and the results are shown in Table 2 below with one set of samples annealed at 800° C. and rapidly cooled to 505° C. before entering the galvanizing bath and another set of samples annealed at 800° C. and rapidly cooled to 515° C. before coating.

Figure 5A:
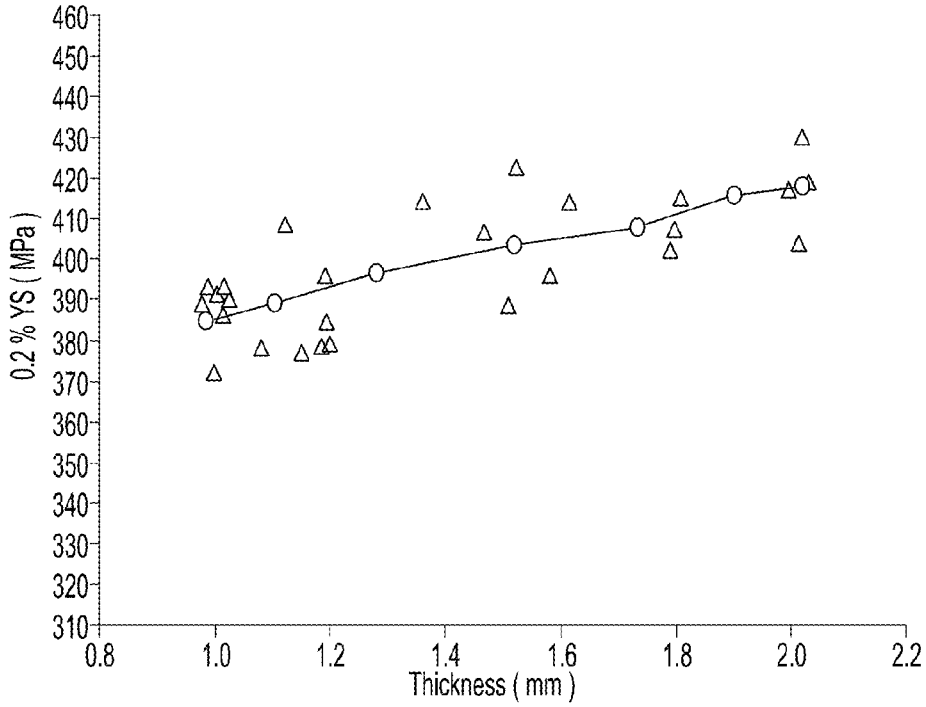
FIG. 5 is a representation of a plurality of data points for: (a) 0.2% yield strength; (b) tensile strength; and (c) percent elongation to failure respectively from dual phase steel sheets obtained according to an embodiment of the present invention.
Figure 5B:
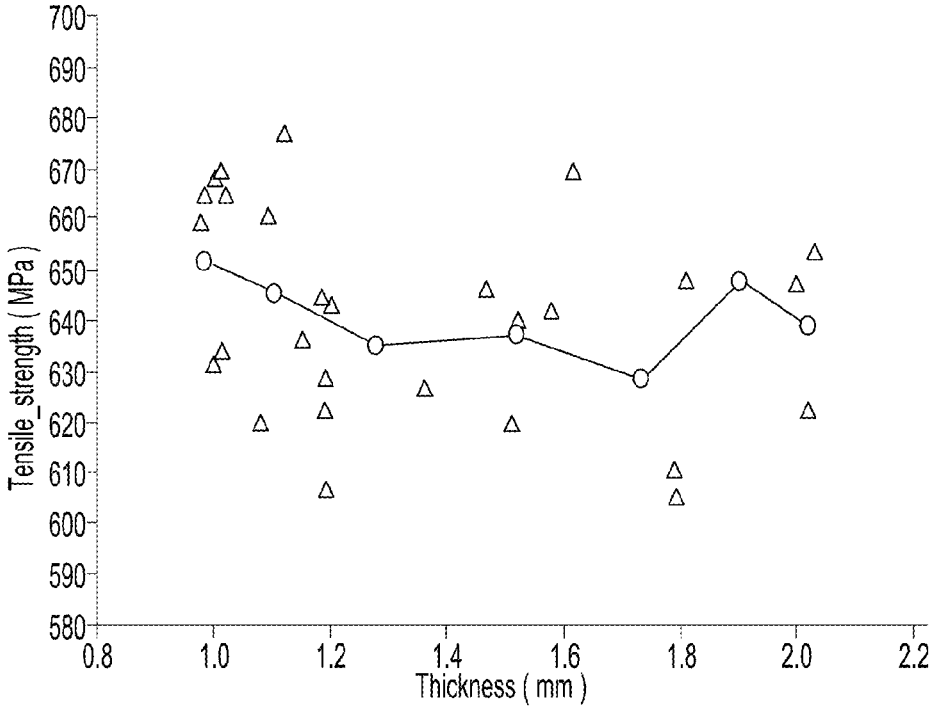
Figure 5C:
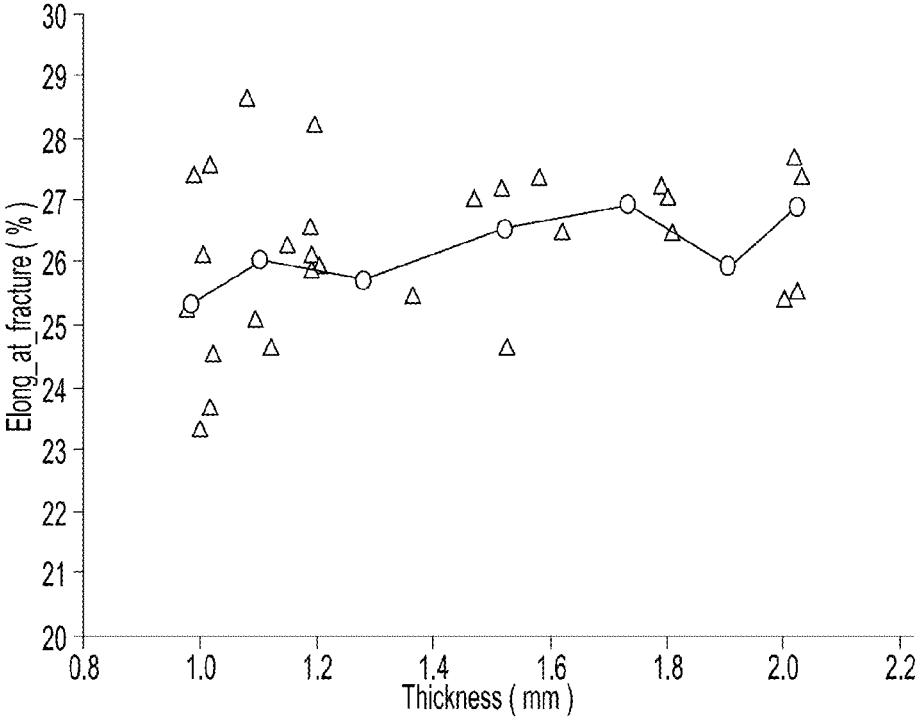
Figure 6:
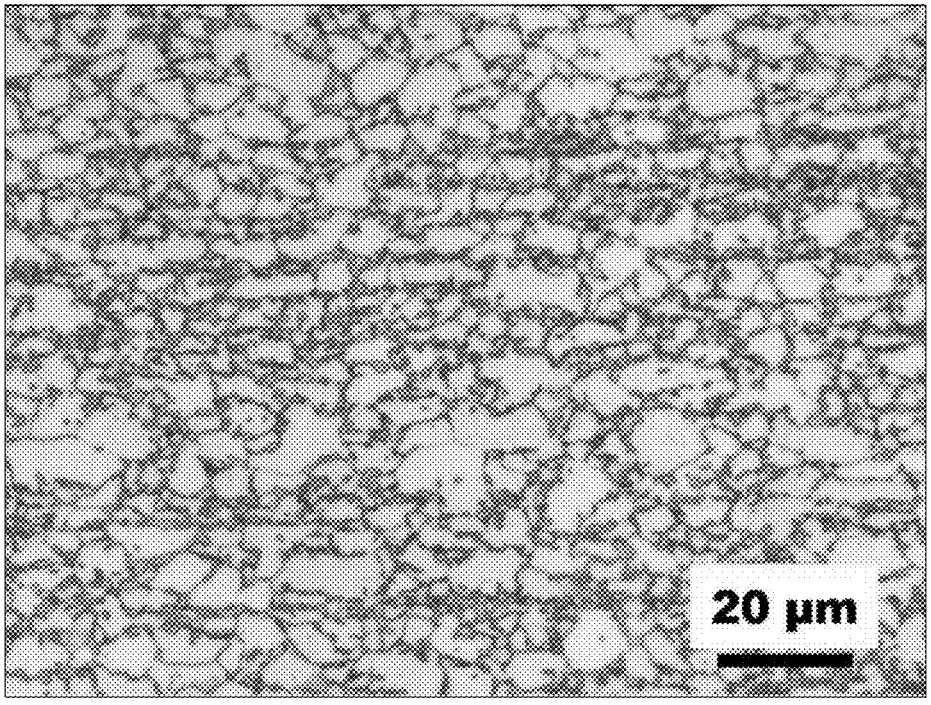
FIG. 6 is an optical micrograph at 1000× of a dual phase microstructure obtained at room temperature from a dual phase steel sheet obtained according to an embodiment of the present invention.

In addition to the properties shown in Table 2, FIGS. 5(*a*), 5(*b*) and 5(*c*) illustrate the 0.2% yield strength, tensile strength and percent elongation to failure, respectively, as a function of sample thickness. The microstructure of the cold-rolled and galvanized steel sheet had a grain size of ASTM 13, and was a composite dual phase structure with islands of martensite within a matrix of ferrite. Also, less than 4 vol % bainite was present in the microstructure. FIG. 6 shows a nital etched dual phase microstructure of the ferrite-martensite microstructure at a magnification of 1000×.

EXAMPLE 2

For comparison, the inventive process described above was altered such that cold rolled sheet from the heats shown in Table 1 and having thicknesses between 0.70-1.70 mm were subjected to: (a) an intercritical anneal at 780° C., instead of 800° C.; (b) rapid cooling to approximately 505° C.+/−10° C.; and (c) passing through a liquid galvanizing alloy having a temperature or temperature range between 455-465° C. The intercritical annealing temperature of 780° C. combined with 'continuously' rapid cooled stop temperature (RC temperature) of 505° C.+/−10° C.—without an isothermal hold near the molten metal pot—also gave an ideal dual phase ferrite-martensite microstructure devoid of bainite and/or pearlite.

Samples of this material were also subjected to mechanical testing properties with the results shown in Table 2 for one set of samples annealed at 780° C. and rapidly cooled to 505° C. before entering the galvanizing bath and another set of samples annealed at 780° C. and rapidly cooled to 515° C. before coating. As shown by the results in Table 2, cold rolled and coated sheet subjected to the higher intercritical annealing temperature performed similarly to the cold rolled steel subjected to the annealing temperature towards the lower end of the specified annealing temperature ranges stated in the current invention.

TABLE 2

| Annealing | Head | | | Tail | | |
|---|---|---|---|---|---|---|
| Cycle Soak-RC (° C.) | 0.2% YS (MPa) | TS (MPa) | % E ASTM | 0.2% YS (MPa) | TS (MPa) | % E ASTM |
| 800° C.-505° C. | 380 | 616 | 24 | 361 | 630 | 25 |
| 800° C.-515° C. | 365 | 630 | 25 | 381 | 658 | 24 |
| 780° C.-505° C. | 387 | 650 | 24 | 385 | 630 | 24 |
| 780° C.-515° C. | 390 | 627 | 24 | 400 | 654 | 24 |

As shown by the data, and in contrast to teachings in the prior art, the elevated intercritical anneal temperature in combination with the absence of an isothermal heat treatment or hold after rapid cooling near the molten metal pot temperature—during which, before or after which the steel is coated—produces a coated dual phase steel sheet with exceptional mechanical properties and a microstructure consisting of martensitic islands in a ferritic matrix.

In view of the teaching presented herein, it is to be understood that numerous modifications and variations of the present invention will be readily apparent to those of skill in the art. The foregoing is illustrative of specific embodiments of the invention, but is not meant to be a limitation upon the practice thereof. As such, the specification should be interpreted broadly.

We claim:

1. A process for producing a coated dual-phase steel, the process comprising:

providing a steel slab with a chemical composition within the range, in weight percent, of 0.085-0.11 C, 1.4-2.0 Mn, 0.19-0.21 Mo, 0.02-0.05 Al, 0.16-0.5 Si, 0.13-0.5 Cr, 0.016 max Ti, 0.06 max Ni, 0.003 max S, 0.015 max P, 0.006 max N, balance Fe and incidental melting impurities;

soaking the steel slab at temperatures between 1160-1280° C.;

hot rolling the steel slab into hot-rolled strip;

coiling the hot rolled strip at temperatures between 600-680° C., the coiled hot rolled strip having a ferrite-pearlite microstructure;

cold-rolling the coiled hot-rolled strip into cold-rolled sheet, the cold-rolled sheet having at least a 60% reduction in thickness compared to the thickness of the coiled hot-rolled strip;

intercritical annealing the cold-rolled sheet at temperatures between 780-820° C.;

rapidly cooling the intercritically annealed cold-rolled sheet in a first cooling step using a first cooling rate to a stop temperature between 505-520° C. without a hold treatment, the stop temperature between 505-520° C. being between 25-65° C. above a molten metal or alloy bath temperature which is between 450-480° C.;

cooling the rapidly cooled sheet in a second cooling step using a second cooling rate from the stop temperature between 505-520° C. to a temperature close to the molten metal or alloy bath temperature which is between 450-480° C., wherein the second cooling rate is less than the first cooling rate; and passing the rapidly cooled sheet through a molten metal or alloy bath at temperatures between 450-480° C. and producing a coated steel sheet, the coated steel sheet having a dual-phase ferrite-martensite microstructure with less than 4 volume percent bainite;

the coated steel sheet having a yield strength of at least 310 MPa, a tensile strength of at least 580 MPa, a total elongation to failure of at least 18%, a uniform elongation of at least 10% and a Lankford coefficient r-value between 0.8-1.1.

2. The process of claim 1, wherein the coated steel sheet has a yield strength between 330-450 MPa, a tensile strength between 590-680 MPa, a total elongation between 21-26% and a uniform elongation between 13-17%.

3. The process of claim 2, wherein the coated steel sheet has a work hardening exponent 'n' between 0.14-0.18.

4. The process of claim 1, further including hot rolling the steel slab into a transfer bar using a roughing treatment;

hot rolling the transfer bar into hot-rolled strip using a finishing treatment, the finishing treatment having an entry temperature between 1050-1120° C. and an exit temperature between 860-910° C.; and cooling the hot rolled strip at a cooling rate between 15-35° C./sec before coiling.

5. A process for producing a coated dual-phase steel, the process comprising:

soaking a steel slab at temperatures between 1160-1280° C., the steel slab having a chemical composition within the range, in weight percent, of 0.085-0.11 C, 1.4-2.0 Mn, 0.19-0.21 Mo, 0.02-0.05 Al, 0.16-0.5 Si, 0.13-0.5 Cr, 0.016 max Ti, 0.06 max Ni, 0.003 max S, 0.015 max P, 0.006 max N, balance Fe and incidental melting impurities;

hot rolling the steel slab into hot-rolled strip, the hot rolling including a finishing treatment with an entry temperature between 1050-1120° C. and an exit temperature between 860-910° C.;

cooling the hot rolled strip at a cooling rate between 15-35° C./sec;

coiling the hot rolled strip at temperatures between 600-680° C., the coiled hot rolled strip having a ferrite-pearlite microstructure;

cold-rolling the coiled hot-rolled strip into cold-rolled sheet, the cold-rolled sheet having at least a 60% reduction in thickness compared to a thickness of the coiled hot-rolled strip;

intercritical annealing the cold-rolled sheet at temperatures between 780-820° C.;

rapidly cooling the intercritically annealed cold-rolled sheet in a first cooling step using a first cooling rate to a stop temperature between 505-515° C. without a hold treatment, the stop temperature between 505-515° C. being between 25-65° C. above a molten metal or alloy bath temperature which is between 450-480° C.;

cooling the rapidly cooled sheet in a second cooling step using a second cooling rate from the stop temperature between 505-515° C. to a temperature close to the molten metal or alloy bath temperature which is between 450-480° C., wherein the second cooling rate is less than the first cooling rate; and passing the rapidly cooled sheet through a molten metal or alloy bath at temperatures between 450-480° C. and producing a coated steel sheet;

the coated steel sheet having a dual-phase ferrite-martensite microstructure with less than 4 volume percent bainite, a yield strength of at least 310 MPa, a tensile strength of at least 580 MPa, a total elongation to failure of at least 18%, a uniform elongation of at least 10% and a Lankford coefficient r-value between 0.8-1.1.

6. The process of claim 5, wherein the coated steel sheet has a yield strength between 330-450 MPa, a tensile strength between 590-680 MPa, a total elongation between 21-26% and a uniform elongation between 13-17%.

7. The process of claim 5, wherein the coated steel sheet has a work hardening exponent 'n' between 0.14-0.18.

* * * * *